US005931727A

United States Patent [19]

Schadow

[11] Patent Number: 5,931,727

[45] Date of Patent: Aug. 3, 1999

[54] MANUAL GRINDING MACHINE-TOOL AND GRINDING TOOL

[75] Inventor: Joachim Schadow, Stuttgart, Germany

[73] Assignee: Robert Bosch GmbH, Stuttgart, Germany

[21] Appl. No.: 08/973,828

[22] PCT Filed: Jun. 19, 1996

[86] PCT No.: PCT/DE96/01080

§ 371 Date: Dec. 9, 1997

§ 102(e) Date: Dec. 9, 1997

[87] PCT Pub. No.: WO97/02111

PCT Pub. Date: Jan. 23, 1997

[30] Foreign Application Priority Data

Jul. 1, 1995 [DE] Germany ..... 195 24 084

[51] Int. Cl.[6] ..... B24B 23/02; B24B 23/04; B24B 23/06

[52] U.S. Cl. ..... 451/355; 451/356; 451/357; 451/359; 451/504

[58] Field of Search ..... 451/344, 351, 451/353, 355, 356, 357, 359, 495, 504, 533, 539, 548, 550

[56] References Cited

U.S. PATENT DOCUMENTS

| | | | |
|---|---|---|---|
| 4,399,578 | 8/1983 | Bordeaux . | |
| 4,510,718 | 4/1985 | Eichenlaub . | |
| 4,831,789 | 5/1989 | Herbin et al. . | |
| 5,672,096 | 9/1997 | Amarosa et al. | 451/504 |

*Primary Examiner*—Timothy V. Eley
*Attorney, Agent, or Firm*—Michael J. Striker

[57] ABSTRACT

A portable grinder (10; 50; 80) with a grinding tool, wherein a flexible cushion (30; 60; 94) is disposed between an abrasive device, particularly an abrasive disk, and a grinding plate becomes particularly useful for working with contoured workpieces, in that the cushion (30; 60; 94) is embodied as volume-variable, an easily malleable container, which can be sealed gas-tight and can be evacuated and is used for receiving granules or fillers (34; 64; 94) of that type.

8 Claims, 3 Drawing Sheets

10
14
16
12
18
20
22
24
26
28
29
30
31
32
33
34
36
37
38
40

10
26
30
31
32
33

MANUAL GRINDING MACHINE-TOOL AND GRINDING TOOL

BACKGROUND OF THE INVENTION

The invention relates to a portable grinder and a tool for the same.

Portable grinding tools are already known, wherein a flexible cushion is disposed between the part performing the grinding motion, i.e. the grinding wheel, and the surface grinding device, in particular the abrasive disk. The flexible cushion causes pressure distribution over a large surface between the portable grinder and the workpiece, so that an even material removal from the surface of the workpiece is possible.

The previously known cushions are essentially plane bodies, which, although they perform a satisfactory job when resting on a level workpiece surface, are less suitable for working contoured surfaces, because they make line or point contact and thus destroy the contoured surfaces during the grinding process.

The use of profiled cushions with the negative profile of the workpiece surface is not known.

Particularly the grinding of elongated outer or inner cylindrical surfaces, for example on the body of boats, aircraft, banister rails or the like is very time-consuming due to the lack of proper grinding tools, wherein the danger arises, that because of the line contact an uneven surface removal takes place and the surface to be worked becomes deformed.

SUMMARY OF THE INVENTION

In contrast to this, the portable grinder or respectively the tool in accordance with the invention have the advantage that there is a quickly adaptable grinding tool, fitting the workpiece profile, making it possible to work even relatively complicated surface profiles in an extremely time saving and exact manner, as for example working turned banister rails or respectively elongated, cylindrical bodies, such as bodies of boats or respectively aircraft parts.

This is achieved in that the flexible cushion forms an imprint of the workpiece surface to be worked in that, after the grinding tool with the cushion has been set down in the manner of a die, the air is pumped out of the cushion, which is filled with soft or hard, coarse or fine-grain granules and is air-tight on its outside. The cushion now retains the imprint of the workpiece surface. This cushion can be fitted onto portable grinders with grinding wheels that move back and forth or that rotate.

If a workpiece with another profile form is to be worked, the grinding wheel is again placed onto the other workpiece, wherein the vacuum is removed by opening a valve in the grinding cushion. In this way the granular parts can rearrange themselves and can again form an imprint of a workpiece surface.

It is of particular advantage, if the cushion envelope is of a flexible, balloon-like composition, so that it is inflatable prior to filling it with granules and does not form any folds during the subsequent air release, when the cushion volume is reduced.

In addition it is advantageous, that the granular-like filler is made of a porous, elastic material, so that the cushion can yield elastically when placed on a workpiece and a gentle pressure transfer can take place or respectively omitting one that is too hard.

Furthermore it is advantageous, if the flexible cushion is outfitted with a retractable valve thus preventing interference with the operation of the grinding tool and if a vacuum pump is non-detachably connected to the portable grinder.

The cushion, from which the air can be released and which is filled with flexible granules, has the advantage that it can be used with rotating grinding tools as well as with those that are operating on back and forth movement, or as a padding with portable grinders or as a cover for the drive or guide pulley of portable grinders, so that any arbitrarily contoured workpiece surfaces can be worked true to measurement over large surfaces by means of all known devices, which were previously only usable for level workpiece surfaces, wherein the grinding cushion firmness can be varied by evacuation to a greater or lesser degree. In this case the base as well as the end faces of the cushion can be arbitrarily contoured and utilized for grinding.

BRIEF DESCRIPTION OF THE DRAWINGS

Exemplary embodiments of the invention will be explained in more detail by means of the associated drawings in the following description.

Shown are in FIG. 1, a linear grinder with a longitudinally contoured, flexible cushion in partial longitudinal section, in FIG. 2 a frontal view of the linear grinder in accordance with FIG. 1, in FIG. 3 an eccentric grinder, whose grinding wheel cushion has a concave, arching work surface, in FIG. 4 a belt grinder with a profileable cushion instead of a contact plate in partial longitudinal section and in FIG. 5 a cross section of the cushion and the abrasive belt in accordance with FIG. 4.

DESCRIPTION OF THE PREFERRED EMBODIMENTS

Figures 1, 2:
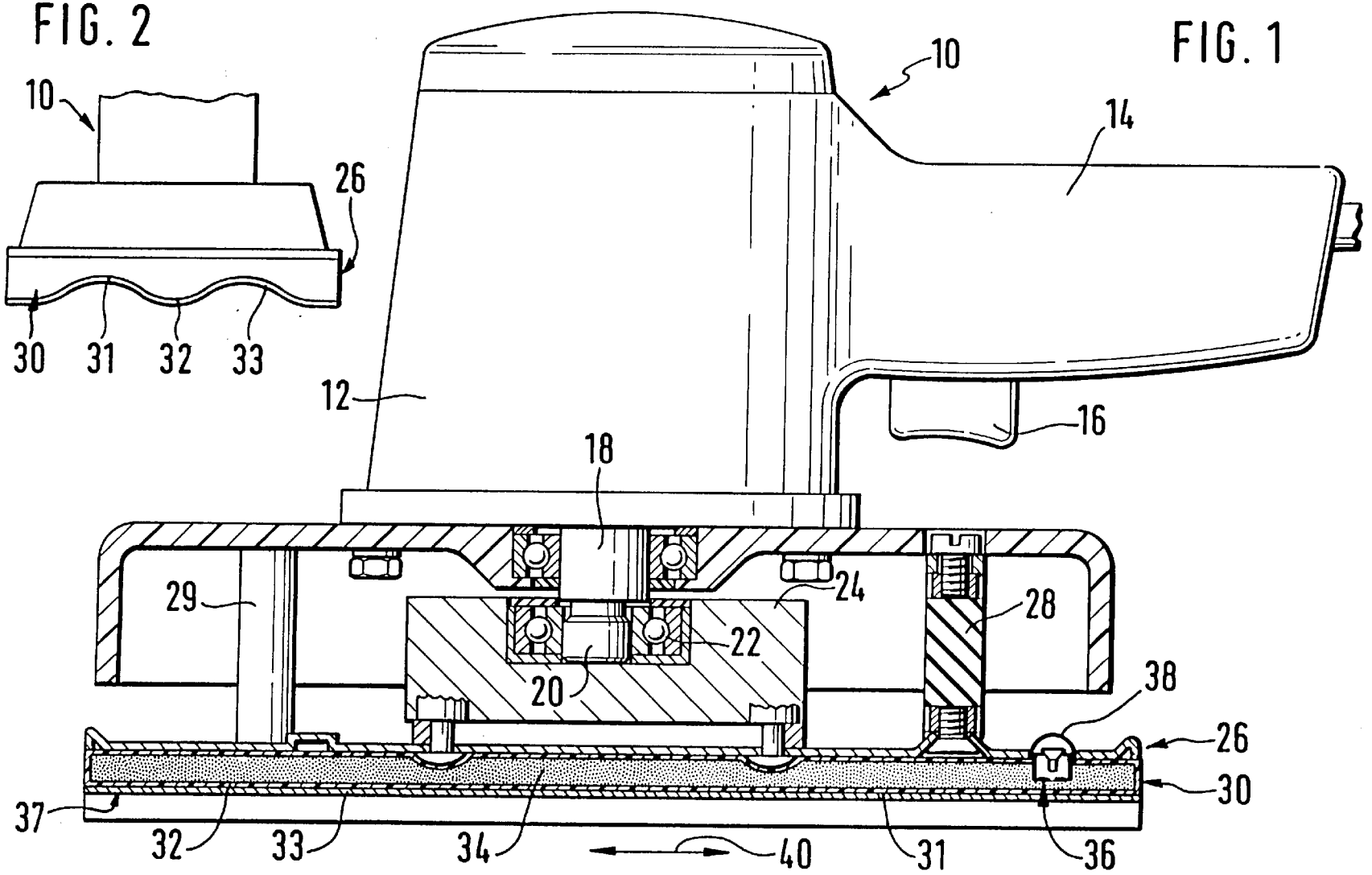

The linear grinder 10 shown in FIG. 1 is comprised of a motor housing 12 with a handle 14, which has a push button 16 for an on-off switch, not shown. A drive shaft 18 extending downward from the motor housing 12 has an eccentric journal 20, which is coupled by way of an anti-friction bearing 22 with a movement transfer link 24 and, via the latter with a grinding wheel 26. The grinding wheel 26 is fastened on the motor housing 12 of the linear grinder 10 by means of elastic floating supports 28, 29. The grinding wheel 26 is a flat sheet metal piece and support a flexible cushion 30 on its underside. This is comprised of a gas tight outer skin 32 and a filler 34, comprised of granules, particularly made of plastic. In its upper area facing the grinding wheel 26, the flexible cushion 30 has a valve 36, which is protected against dust by a valve cover 38. The underside 31 of the cushion 30 has an abrasive disk 33, whose longitudinal concave profile is adapted to the underside 31. A continuous line has a profiled edge 37 deeply imprinted into the underside 31 of the cushion 30.

With the aid of a vacuum pump, not shown, which can be placed on valve 36, the air contained in the cushion 30 can be released. In this way a vacuum is created in the cushion 30. Because of the vacuum, the filler is maintained in its respective position. If in the process the cushion 30 is pressed onto a contoured base, an imprint of the base is created on the underside 33 of the cushion 30, which can be retained by means of the evacuation of the air. The grinding wheel 26 can be linearly moved back and forth in accordance with the moving direction of the arrow 40.

FIG. 2 shows a frontal view of the linear grinder 10. In this case the double concave, arched underside 31 of the cushion 30 to which the abrasive disk 33 is attached, for example by means of a Velcro fastener, is clearly identifiable. If this cushion 30 is placed on a corresponding profile to which it has previously been adapted, the arched areas of the workpiece can be worked with it in longitudinal direction with even pressure over large areas of the surface.

Compared with commonly known grinding devices, no line contact but contact over a large area takes place between the tool or respectively an abrasive paper 33 and a workpiece. The process is speeded up and the abrasive disk 33 gets an even wear and thus has a longer service life than is the case with plane tools.

Figure 3:
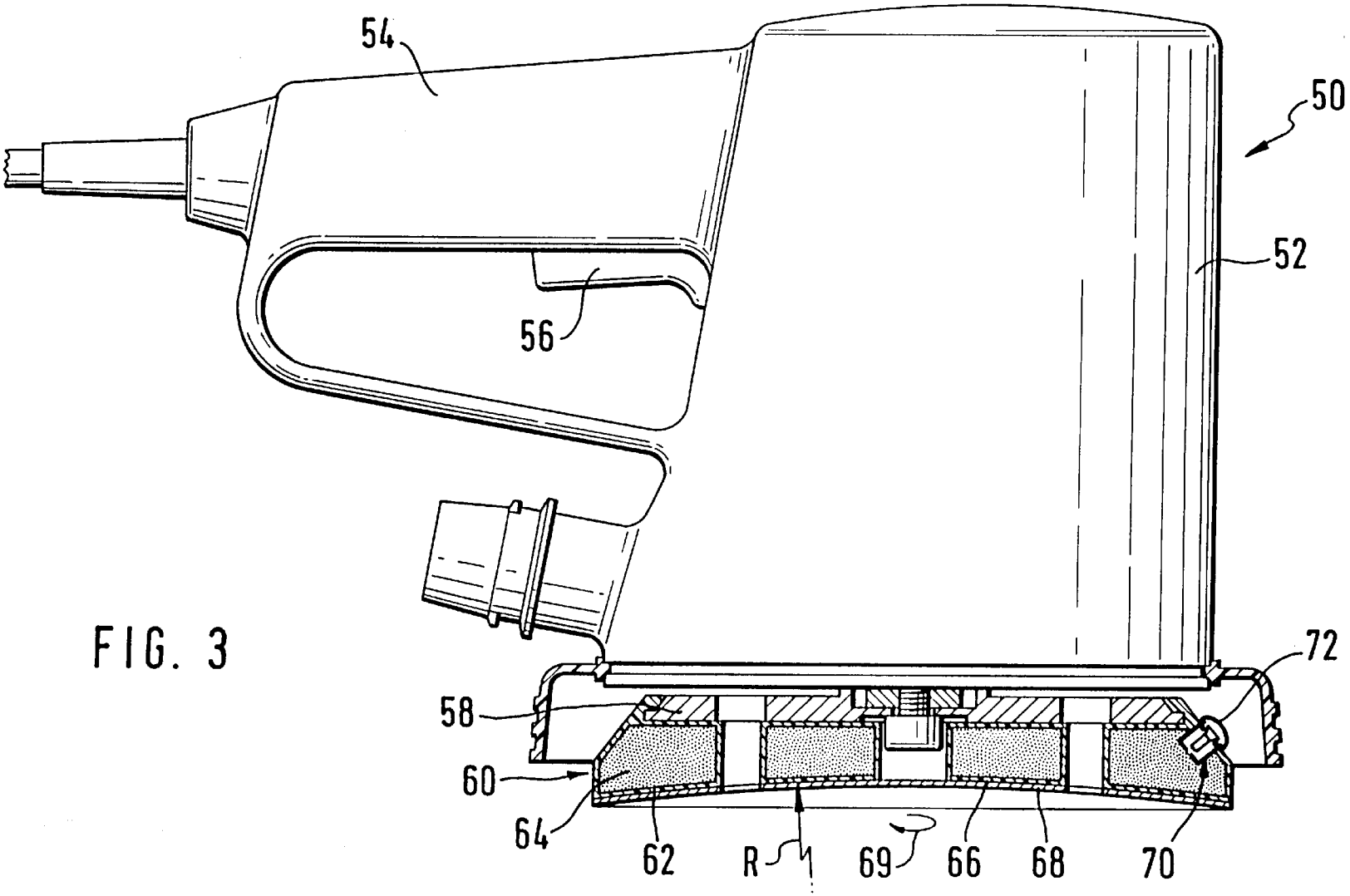

In FIG. 3 an eccentric grinder 50 is shown with a motor housing 52 having a handle 54 with a push button 56 for the electrical on-off switch. At its lower end the eccentric grinder 50 has a grinding wheel 58 with a flexible cushion 60, which is fitted with a gas-tight skin 62 and filled with a filler 64 of elastic granules. The work surface 66 of the flexible cushion 60 has an abrasive disk 68 and is concavely arched as imprint of a convex workpiece with a radius of curvature R. The abrasive disk 68 adapts to the concave form of the work surface 66, and it is thus possible to work large areas of a workpiece surface convexly curved with a radius R, when the grinding wheel 58 is turned around its vertical axis, for example in the direction of the arrow 69.

The flexible cushion 60 has a valve 70 on its upper side, which can be sealed with a valve cover 72 for protection against dust.

Figure 4:
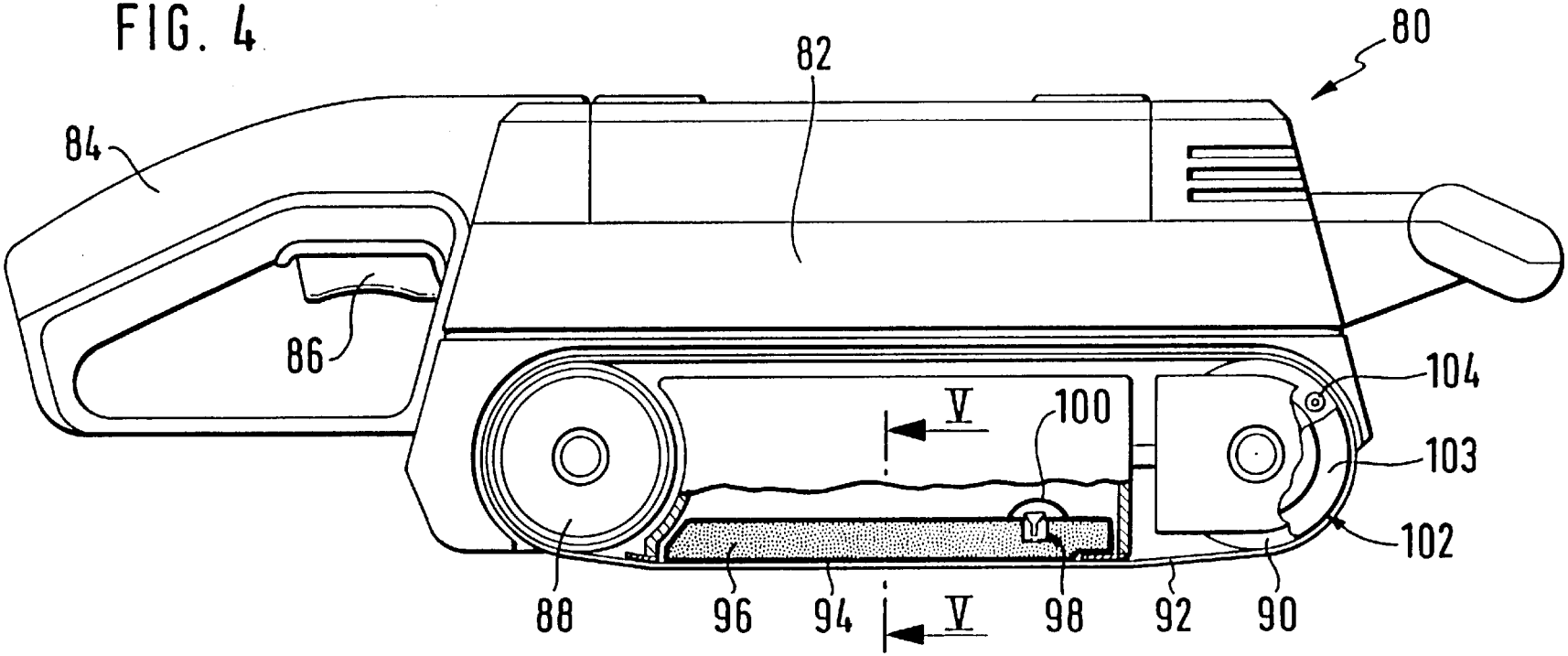

The portable belt grinder 80 shown in FIG. 4 is comprised of a housing 82 with a handle 84. The handle 84 has a push button 86 for an electrical on-off switch, not shown. The portable belt grinder 80 has two axis-parallel pulleys 88, 90 with a rotating grinding belt 92. A contact plate 94 is located between the pulleys 88, 90, which constitutes the underside of a flexible cushion provided with a filler 96 consisting of elastic granules. On the upper side the contact plate 94 has a valve 98 with a valve cover 100. Also, the pulley 90 has a hollow cylindrical, cushion-like envelope 102.

The envelope 102 is filled with a filler 103 of elastic granules. At its axial outer end, the pulley 90 has a valve 104, which is sealable with a cover, not shown.

Figure 5:
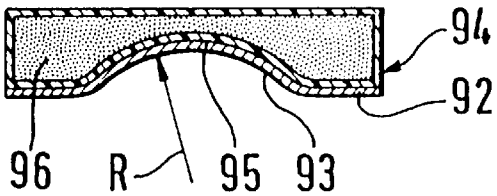

FIG. 5 shows a cross-section of the contact plate 94, wherein its concave profile 95 with the radius R can be seen. The grinding belt 92 adapts easily with its curvature 93 to the profile 95.

If the portable belt grinder is guided over a pipe which is convexly curved with a radius R, it can be ground particularly effectively and rapidly over a large area. In this case a large area contact exists between the grinding belt 92 and the curved workpiece and not, as with plane portable belt grinders, a line contact.

In an exemplary embodiment of a portable grinder, not shown, a flexible cushion is inflated like a balloon and filled with granules. By releasing the excessive pressure from this cushion, the granules are pressed together because of the malleable shape of the cushion. In this case only a slight vacuum is necessary in order to create imprints of workpiece surfaces to be worked with the cushion.

Of particular advantage for the retention of the shape of the cushion, even in cases of large forces acting on the cushion, is the use of granules, whose individual pellets have a high degree of coarseness or surfaces that are not round, which favor the hooking together of the granulate bodies.

I claim:

1. A portable grinder, comprising a grinding tool including a grinding plate and an abrasive element; and a flexible cushion located between said grinding plate and said abrasive element, said cushion including an easily malleable and gas-tight sealable and evacuable container and a filler accommodated in said container, said filler being formed as granules composed of foamed, flexible plastic material.

2. A portable grinder, comprising a grinding tool including a grinding plate and an abrasive element; and a flexible cushion located between said grinding plate and said abrasive element, said cushion including an easily malleable and gas-tight sealable and evacuable container and a filler accommodated in said container, said cushion having a variable volume, said filler being formed of granules, said container being formed as a bag of plastic material which has an air-tight, sealable filling opening for said granules, said container having at least one flexible surface which is inflatable like a balloon, said container also having a valve from which air contained in said container can be released.

3. A portable grinder as defined in claim 2, wherein said granules is a mass whose shape is changeable.

4. A portable grinder as defined in claim 2; and further comprising a vacuum pump for releasing air contained in said container, said vacuum pump being connected to said container in a non-detachable manner.

5. A portable grinder as defined in claim 2, wherein said portable grinder is embodied as an orbital grinder.

6. A portable grinder as defined in claim 2, wherein said portable grinder is embodied as an rotational grinder.

7. A portable grinder as defined in claim 2, wherein said portable grinder is embodied as a portable belt grinder.

8. A grinding tool, comprising a grinding tool including a grinding plate and an abrasive element; and a flexible cushion located between said grinding plate and said abrasive element, said cushion including an easily malleable and gas-tight sealable and evacuable container and a filler accommodated in said container, said cushion having a variable volume, said filler being formed of granules, said container being formed as a bag of plastic material which has an air-tight, sealable filling opening for said granules, said container having at least one flexible surface which is inflatable, said container also having a valve with which air contained in said container can be released.

* * * * *